US008444286B2

(12) United States Patent
Yasuoka

(10) Patent No.: US 8,444,286 B2
(45) Date of Patent: May 21, 2013

(54) LIGHTING APPARATUS

(75) Inventors: Norio Yasuoka, Osaka (JP); Sachiko Yasuoka, legal representative, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 1 day.

(21) Appl. No.: 13/130,981

(22) PCT Filed: Nov. 2, 2009

(86) PCT No.: PCT/JP2009/005825

§ 371 (c)(1),
(2), (4) Date: Aug. 10, 2011

(87) PCT Pub. No.: WO2010/061531

PCT Pub. Date: Jun. 3, 2010

(65) Prior Publication Data

US 2012/0026743 A1 Feb. 2, 2012

(30) Foreign Application Priority Data

Nov. 25, 2008 (JP) ..... 2008-299718

(51) Int. Cl.
*F21S 8/00* (2006.01)
*F21S 8/02* (2006.01)
*F21S 8/04* (2006.01)

(52) U.S. Cl.
USPC ..... 362/147; 362/148; 362/404

(58) Field of Classification Search
USPC ..... 362/147–150, 576, 368, 370, 371, 362/404–409
See application file for complete search history.

(56) References Cited

U.S. PATENT DOCUMENTS 6,893,139 B2 * 5/2005 Cercone et al. ..... 362/147

FOREIGN PATENT DOCUMENTS

| | | | | |
|---|---|---|---|---|
| JP | 63-20306 | U | | 2/1988 |
| JP | 02123609 | A | * | 5/1990 |
| JP | 5-74218 | A | | 3/1993 |
| JP | 6-17034 | U | | 3/1994 |
| JP | 8-31219 | A | | 2/1996 |
| JP | 9-231829 | A | | 9/1997 |
| JP | 11-134927 | A | | 5/1999 |
| JP | 2000100235 | A | * | 4/2000 |
| JP | 2004-8042 | A | | 1/2004 |
| JP | 2004171900 | A | * | 6/2004 |
| JP | 2004-327138 | A | | 11/2004 |

* cited by examiner

*Primary Examiner* — Mariceli Santiago
(74) *Attorney, Agent, or Firm* — Birch, Stewart, Kolasch & Birch, LLP

(57) ABSTRACT

A lighting apparatus includes a metal mounting fixed to a needed place such as a ceiling or a wall, rod-shaped holding metal fixtures, and a lighting apparatus body constituted by a chassis to which one end portion of each holding metal fixture is loosely fitted, a board which is fixed to the chassis and on which light emitting diodes are mounted as luminous elements, a reflecting panel, a cover (diffusing panel) that covers the light emitting diodes, and so on. By inserting the lock section of the other end portion of each holding metal fixture into an insertion hole and then locking each holding metal fixture on the metal mounting, the lighting apparatus body is held in a state of being separated from the metal mounting.

14 Claims, 15 Drawing Sheets

FIG. 9

| CONTROL STATE | ILLUMI-NANCE | LED (WARM WHITE) | LED (WHITE) |
|---|---|---|---|
| S1 (ALL LIGHTING) | E1 | 100% | 100% |
| S2 | E2 | 100% | 60% |
| S3 | E3 | 100% | 30% |
| S4 | E4 | 100% | 0% |
| S5 | E5 | 30% | 0% |
| S6 (LIGHTS OUT) | E6 | 0% | 0% |

LIGHTING APPARATUS

This application is the national phase under 35 U.S.C. §371 of PCT International Application No. PCT/JP2009/005825 which has an International filing date of Nov. 2, 2009 and designated the United States of America.

BACKGROUND

1. Technical Field

The present invention relates to a lighting apparatus that includes a mounting member to be placed on a mounting surface such as a ceiling and that includes a lighting apparatus body with a light source to be mounted to the mounting surface through the mounting member.

2. Description of Related Art

In recent years, a new lighting apparatus, in which a light emitting diode or the like is used as a light source instead of a fluorescent lamp and an incandescent lamp, has been developed as a lighting apparatus in which a more power saving is achieved and which has a longer life. Such a lighting apparatus has a structure where a board on which a plurality of light emitting diodes (LEDs) are mounted is fitted to a bottom surface of a casing of the lighting apparatus.

On the other hand, with regard to a lighting apparatus in which a fluorescent lamp or incandescent lamp is used and which is to be directly mounted to a ceiling or the like, its lighting apparatus body is to be fitted to a metal mounting fixed to the ceiling or the like. With mounting work including wiring work to be carried out on this lighting apparatus, access to the interior of its lighting apparatus body can be performed by previously removing a cover such as a diffusing panel, and the mounting work can, therefore, be carried out relatively easily (see Japanese Patent Application Laid-Open No. 5-74218).

SUMMARY

In a case where light emitting diodes or the like are used in a conventional lighting apparatus to be mounted to a ceiling or the like as a light source, however, even if a structure where a cover, such as a diffusing panel, is removed is formed, it will not be easy to carry out work on a luminous surface side because the light emitting diodes are provided on the luminous surface. In particular, to secure as broad a luminous surface as possible, it is not preferable to provide components necessary for mounting work at a luminous surface side. On the other hand, in cases where a plurality of light emitting diodes are mounted on a board fixed to a lighting apparatus body, only low workability is secured because the lighting apparatus body itself is heavy. Therefore it has been desired that a lighting apparatus of which a lighting apparatus body can be easily mounted be produced.

Considering such circumstances, the present invention has been completed; that is, an object of the present invention is to provide a lighting apparatus that can be mounted easily.

A lighting apparatus according to the present invention is characterized by including a mounting member to be fixed to a mounting surface such as a ceiling or the like, a lighting apparatus body in which a light source is provided and which is to be mounted to the mounting surface through the mounting member, and a holding member holding the lighting apparatus body such that a space is provided between the mounting surface and the lighting apparatus body.

In the lighting apparatus according to the present invention, the holding member is provided to hold the lighting apparatus body such that a space is provided between the mounting member and the lighting apparatus body. For example, after having fixed the mounting member to a ceiling, the lighting apparatus body is fitted to the mounting member by using the holding member, whereby a space is provided between the ceiling and the lighting apparatus body. By providing components necessary for mounting work including wiring work on the upper surface side of the lighting apparatus body (the side opposite to a luminous surface), a space necessary for the mounting work can be secured with the lighting apparatus body held by the holding member, and the mounting work can, therefore, be easily carried out. And further, work at the luminous surface side becomes unnecessary, and there is no need to provide the components necessary for the mounting work at the side of the luminous surface, whereby it is possible to secure a broad luminous surface.

The lighting apparatus according to the present invention is characterized in that provided is a housing section housing the holding member between the lighting apparatus body and the mounting member when the lighting apparatus body is mounted to the mounting surface.

In the lighting apparatus according to the present invention, when the lighting apparatus body has been mounted to the mounting surface after the mounting work including wiring work was carried out with the lighting apparatus body held with the holding member, the holding member cannot be seen from outside because the holding member can be housed between the lighting apparatus body and the mounting member, and a neat appearance can, therefore, be imparted to the lighting apparatus.

The lighting apparatus according to the present invention is characterized in that the holding member is shaped into a rod, one end portion of the holding member is fitted to the lighting apparatus body, the other end portion thereof has a lock section to be locked on the mounting member, and the mounting member has an insertion hole into which the lock section is inserted so as to lock the holding member.

According to the present invention, the holding member is shaped into a rod, one end portion of the holding member is loosely fitted to the lighting apparatus body, the other end portion has the lock section to be locked on the mounting member, and the mounting member has the insertion hole into which the lock section is to be inserted so as to lock the holding members. For example, in a case where wiring work is carried out at the lighting apparatus body, by inserting the other end portion of the holding member loosely fitted to the lighting apparatus body into the insertion hole of the mounting member and then locking the holding member on the mounting member, the lighting apparatus body is held with a space secured between the lighting apparatus body and the mounting member. Since the holding member is shaped into a rod, the mounting work is not obstructed. And further, even in a case where the lighting apparatus body is heavy because a number of luminous elements, such as light emitting diodes, are mounted as a light source, the lighting apparatus body can be held easily because it does not have a complex structure.

The lighting apparatus according to the invention is characterized in that the mounting member has a guide extending from the insertion hole, and the holding member slides along the guide.

The lighting apparatus according to this invention has a structure in which the mounting member has the guide extending from the insertion hole and the holding member slides along the guide. For example, when the mounting work including the wiring work has been finished in a state in which the lighting apparatus body is held with a spacing kept from the mounting member, by pushing up the lighting apparatus body toward the mounting member fixed to the ceiling, the lock section side of the holding member slides along the guide, and the lighting apparatus body can, therefore, be brought close to the mounting member. Then the holding member is housed along the guide with the lighting apparatus body fitted to the mounting member. Incidentally, to fit the lighting apparatus body to the mounting member, a hole, an aperture, a notch, or the like can be provided at one of these components, and a hooking section that can be put in the hole, the aperture, the notch, or the like can be provided at the other of these components.

The lighting apparatus according to this invention is characterized in that an angle formed between the holding member and the guide is greater than 90° in a state of holding the lighting apparatus body.

In this invention, the angle formed between the holding members and the guide is greater than 90° with the lighting apparatus body held by the holding member. Therefore, when the lighting apparatus body has been pushed up toward the mounting member fixed to the ceiling, a force that makes the holding member slide along the guide operates; that is, by merely pushing up the lighting apparatus body, it is possible to easily slide the holding member along the guide.

The lighting apparatus according to the invention is characterized in that the lighting apparatus body includes a chassis to which the holding member is fitted, a luminous surface that has a luminous element and is fitted to the chassis, and a cover that covers the luminous surface.

In this invention, the mounting work becomes unnecessary at the luminous surface side where the luminous element is provided. And further, even when the lighting apparatus body is heavy, the mounting work can be easily carried out.

According to the present invention, work of mounting a lighting apparatus to a mounting surface can be easily carried out. Moreover, working at a luminous surface side becomes unnecessary, and there is no need to provide components necessary for the mounting work at the luminous surface side, whereby a broad luminous surface can be secured.

The above and further objects and features will more fully be apparent from the following detailed description with accompanying drawings.

BRIEF DESCRIPTION OF THE SEVERAL VIEWS OF THE DRAWINGS

FIG. 9 is a table showing several examples of control states set at the lighting apparatus according to the first embodiment;

DETAILED DESCRIPTION

First Embodiment

Figure 1:
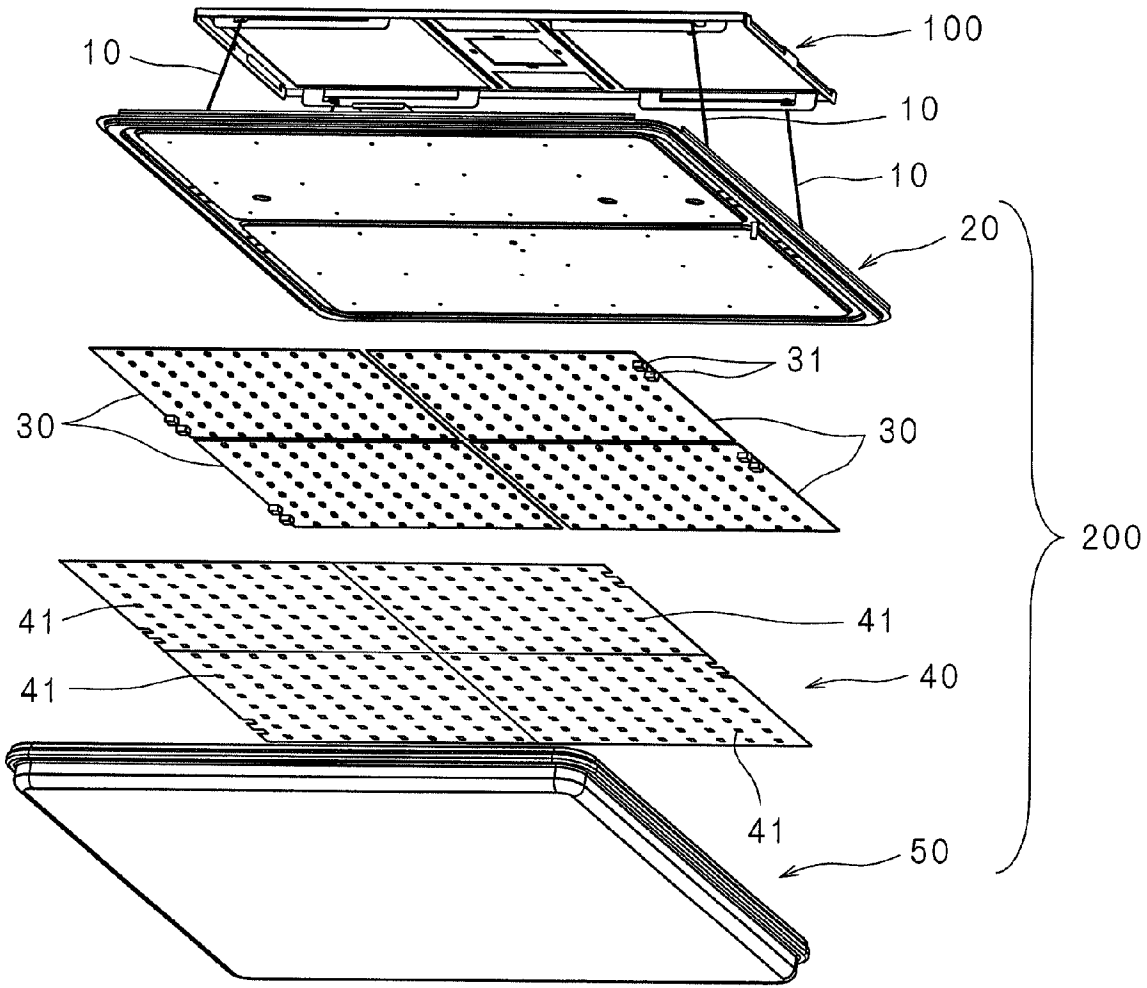
FIG. 1 is a schematic exploded perspective view of a lighting apparatus according to a first embodiment of the present invention.

The present invention will be described below with reference to the drawings showing embodiments of the invention. FIG. 1 is a schematic exploded perspective view of a lighting apparatus according to an embodiment of the present invention. The lighting apparatus according to the invention includes a metal mounting 100 fixedly mounted at a needed place on a mounting surface, such as a ceiling or a wall, as a mounting member, holding metal fixtures 10 as a holding member, and a lighting apparatus body 200 that includes a chassis 20 to which the holding metal fixtures 10 are loosely fitted, a board 30 that is fixed to the chassis 20 and on which light emitting diodes are implemented as a luminous element, a reflecting panel 40, a cover (diffusing panel) 50 that covers a luminous surface constituted by the light emitting diodes, and so on. The lighting apparatus body 200 is held with the holding metal fixtures 10 in a manner that is separated from the metal mounting 100. In the reflecting panel 40, holes 41 are made to insert the light emitting diodes.

By holding the lighting apparatus body 200 with the holding metal fixtures 10, a blank portion (space), e.g., can be provided between a mounting surface, such as a ceiling, and the lighting apparatus body 200. By further providing components necessary for mounting work including wiring work on the upper surface side of the lighting apparatus body 200 (the side opposite to the luminous surface), a blank portion necessary for the mounting work can be obtained with the lighting apparatus body 200 held with the holding metal fixtures 10, and the mounting work can, therefore, be readily carried out. And further, since it becomes unnecessary to carry out work on the luminous surface side, there is no need to provide the components necessary for the mounting work on the luminous surface side, whereby such a wide luminous surface can be obtained. Each individual component will be described below.

Figure 2:
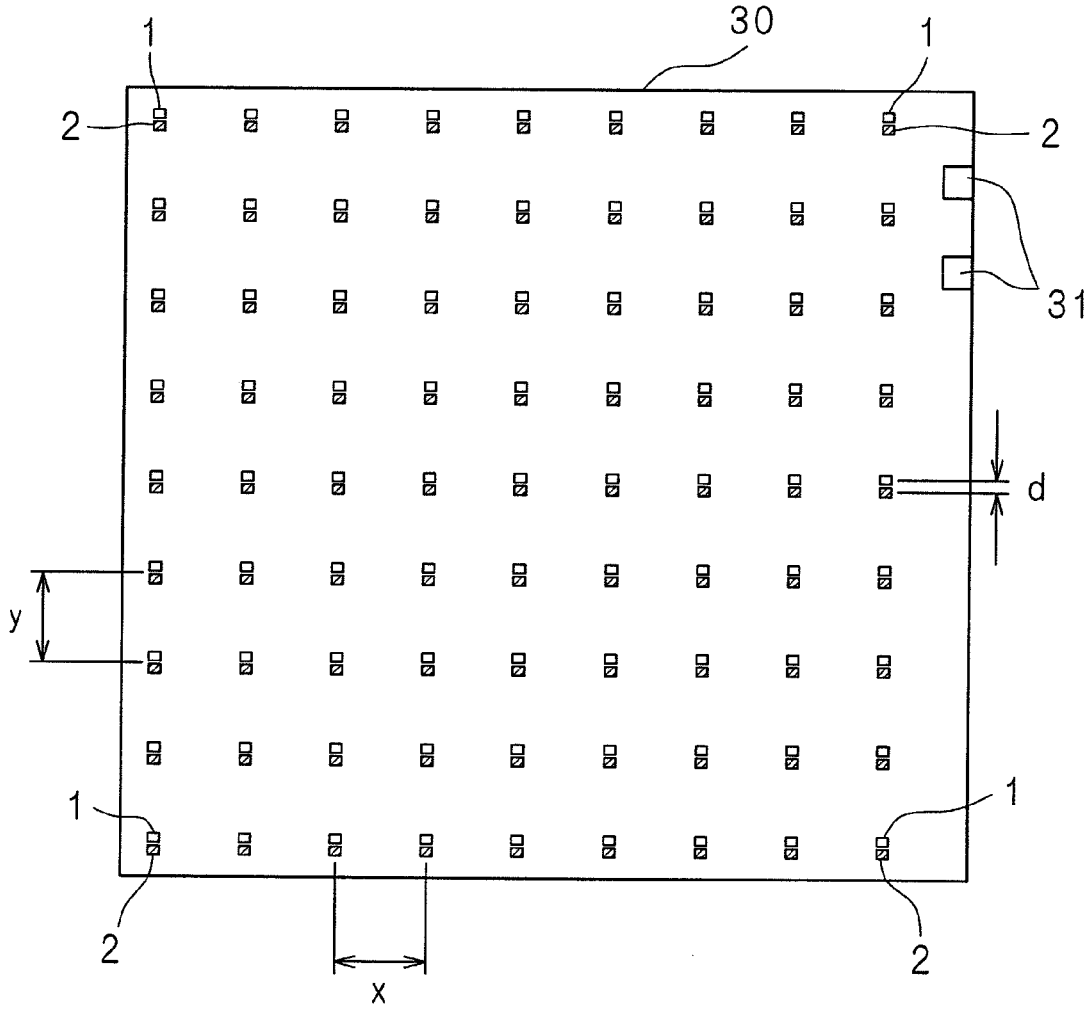
FIG. 2 is a plan view of an example of a board.

FIG. 2 is a plan view of an example of the board 30. As shown in FIG. 2, the board 30 has a rectangular shape, for example. On the board 30, a plurality of light emitting diode sets, which each consist of the light emitting diode 1 and the light emitting diode 2 as luminous elements different in color temperature, are arranged in lattice form. With each diode set, the light emitting diodes 1 and 2 are adjacently provided with a separation distance d set (at 0.5 mm or 1 mm, for example) between them. Reference letter x in FIG. 2 denotes a separation distance in the row direction (the x direction) between the adjacent diode sets, and reference letter y denotes a separation distance in the column direction (the y direction) between the adjacent diode sets. In this case, the separation distance d between the light emitting diode 1 and the light emitting diode 2 that constitute one diode set is made shorter than the separation distances x and y (of about 10 mm or 20 mm, for example) between the adjacent diode sets. Put another way, the separation distances x and y between the adjacent diode sets are made longer than the separation distance d between the light emitting diode 1 and the light emitting diode 2 that constitute one diode set. In that case, the distances x and y may be the same, or may be different from each other. And further, in the example of FIG. 2, although the diode sets are arranged such that the row and column directions are perpendicular to the perimeter of the board 30, the diode sets may be arranged in lattice form such that both the directions are not perpendicular to the perimeter of the board 30. Therefore, even in a case where the luminous surface has any shape, even light emission can be achieved. Moreover, by evenly spacing the diode sets such that the separation distances x and y are the same, a luminous surface that evenly emits light can be implemented.

In a case where another board 30 is placed next to the board 30, positions of the outermost light emitting diode sets on both the boards 30 and a separation distance between both the boards 30 are predetermined such that a separation distance in the row direction between the outermost diode sets on both the boards 30 is set at a value x or that a separation distance in the column direction between the outermost diode sets on the boards 30 is set at a value y. Therefore, in a case where a broad luminous surface is formed by plurally placing the board 30 as well, the separation distances between the diode sets on the board 30 can be made the same as the separation distances between the diode sets on the adjacent board 30, whereby a luminous surface capable of evenly emitting light can be implemented.

As each light emitting diode 1, a warm white light emitting diode, e.g., is used; the color temperature of the warm white light emitting diode can be set at about 2800 K. Incidentally, examples of the warm white light emitting diode include a blue light emitting diode, and a white light emitting diode made with a yellow fluorescent material and a red fluorescent material. And further, as each light emitting diode 2, a high-color-rendering white light emitting diode having a color temperature of about 4000 K is used; examples of such a white light emitting diode include a blue light emitting diode and a white light emitting diode made with a green fluorescent material and a red fluorescent material. Note that those fluorescent materials contained in the warm white light emitting diode and the high-color-rendering light emitting diode have been mentioned as several examples and the kinds of those materials are, therefore, not limited. By using such a high-color-rendering white light emitting diode as one of the two diodes that constitute each diode set, the color rendering of the other light emitting diode can be complemented. Moreover, any emission spectrum may form provided that high-color-rendering white light is emitted. In addition, another light source, such as an EL (electroluminescence) element, may be used instead of each light emitting diode.

At the perimeter of the board 30, wiring connectors 31 are provided to apply needed voltages to the light emitting diodes 1 and 2. The provision of the connectors 31 at the perimeter of the board 30 makes it possible to prevent uneven light emission caused by casting of a shadow and so on at the luminous surface due to partial blocking of light emitted from the light emitting diodes 1 and 2 by wiring and so on.

By making the separation distances x and y longer than the separation distance d, colors of light beams emitted from the luminous elements different in color temperature mix together. As a result, the luminous elements looks as if they were a single-color light source; therefore, light from the luminous surface does not give disagreeable feeling, and thus the lighting apparatus does not become unsightly. And further, a reduction of the separation distance between the two luminous elements constituting one diode set makes it possible to shorten a distance necessary for mixture of colors of light beams emitted from the luminous elements and to place the cover, such as the diffusing panel, for covering the luminous elements with the cover brought close to the luminous elements, whereby a low-profile lighting apparatus can be implemented. In particular, in a case where the diode sets are spaced evenly (such that the separation distances x and y are the same), making a spacing between the diffusing panel and each luminous element wider than the spacing between the diode sets makes it impossible to see the light source through the cover with colors of light beams from the luminous elements different in color temperature mixed evenly, whereby it is possible to make the luminous surface look as if the surface evenly emitted single-color light.

Since the ordinary light emitting diodes 1 and 2 different in color temperature are merely provided adjacently (at the short separation distance d, for example) as a single light emitting diode, there is no need to further provide special light emitting diodes, and a production cost of the whole lighting apparatus can, therefore, be reduced. Moreover, since the two light emitting diodes 1 and 2 are adjacently provided, heat generated at the light emitting diodes 1 and 2 is separated into individual heat packages, and an enhanced heat-release effect is therefore achieved.

Figure 3:
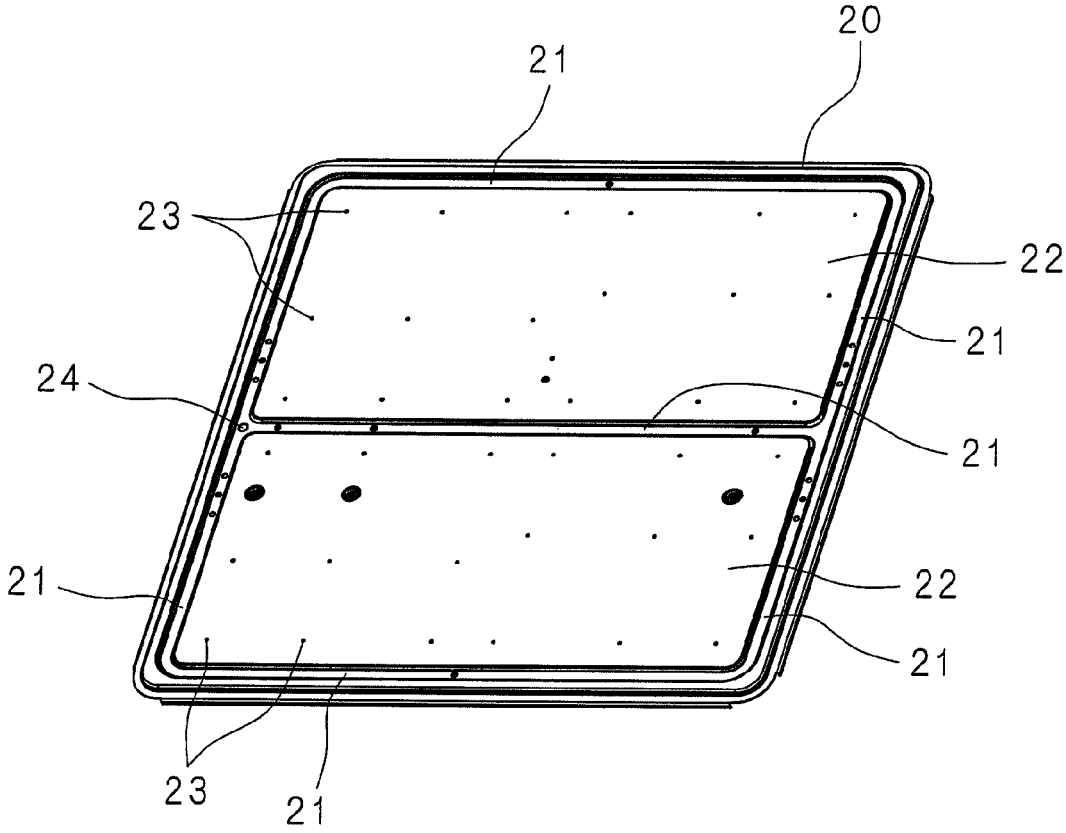
FIG. 3 is an external perspective view of a chassis.

FIG. 3 is an external perspective view of the chassis 20. Dimensions of the chassis 20 are set to the extent that the four boards 30 can be adjacently fixed in a manner that shapes the entire four boards into a tetragon. The chassis 20 is made with a metal such as aluminium, and further functions as a radiator plate that radiates heat generated at the light emitting diodes. At the entirety of a portion near the perimeter of the chassis 20 and across central portions of two opposite sides of the four sides of the chassis 20, a groove 21 is made to house the wiring connected to the connectors 31 provided on the board 30. In fixing surfaces 22 for fixing the board 30, screw holes 23 are made at a predetermined spacing to screw the board 30 on. At a needed place of the groove 21, a hole 24 is made to draw the wiring from the board 30 fitting surface side of the chassis 20 (the luminous surface side) to the upper surface side (the side opposite to the board 30) of the lighting apparatus body 200.

By providing the groove 21 on the board 30 fitting surface side of the chassis 20, light emitted from the light emitting diodes 1 and 2 can be prevented from being partially blocked by the wiring, and casting of a shadow on the luminous surface by the wiring can be prevented, whereby uneven light emission can be prevented.

Figure 4:
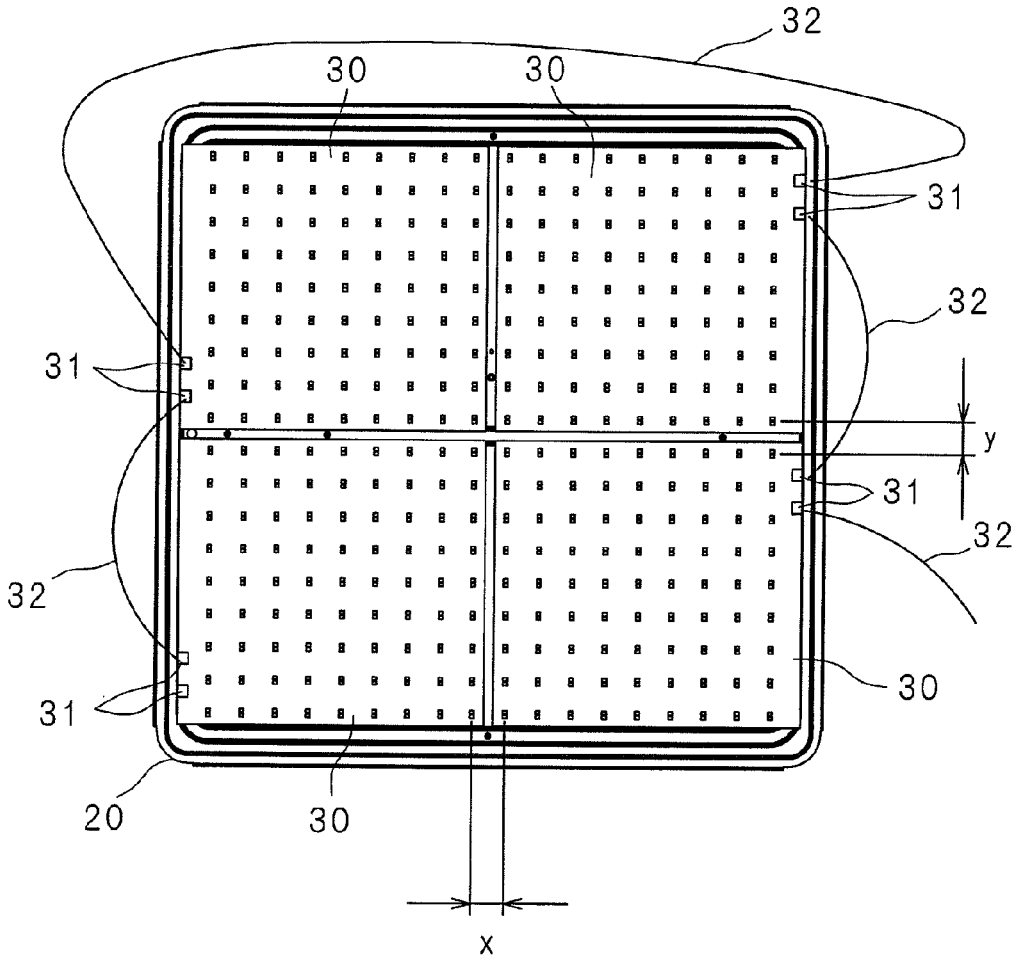
FIG. 4 is a plan view of the board showing an example of a state in which the board is placed on the chassis.

FIG. 4 is a plan view of the boards 30 showing an example of a state in which the boards 30 are fitted to the chassis 20. In FIG. 4, the four boards 30 are placed by way of example; however, the number and layout of the boards 30 are not limited to such an example. And further, as described above, in the case where another board 30 is placed next to the board 30, positions of the outermost light emitting diode sets on the boards 30 and a separation distance between the boards 30 are predetermined such that a separation distance in the row direction between the outermost diode sets on the boards 30 is set at a value x or that a separation distance in the column direction between the outermost diode sets on the boards 30 is set at a value y. Therefore, in a case where a broad luminous surface is formed by plurally placing the board 30 as well, the separation distances between the diode sets on the board 30 can be made the same as the separation distances between the diode sets on the adjacent boards 30, whereby a luminous surface capable of evenly emitting light can be implemented.

In FIG. 4, the right-hand two boards 30 are placed in a manner that gives the two boards 30 a turn at an angle of 180° with respect to the left-hand two boards 30. As a result, all the connectors 31 can be provided at the perimeter of the luminous surface, and light can, therefore, be emitted from the entire luminous surface; moreover, since the same four boards 30 can be used, that is, since commonality of the boards 30 can be implemented, a cost reduction can be implemented.

Figure 5:
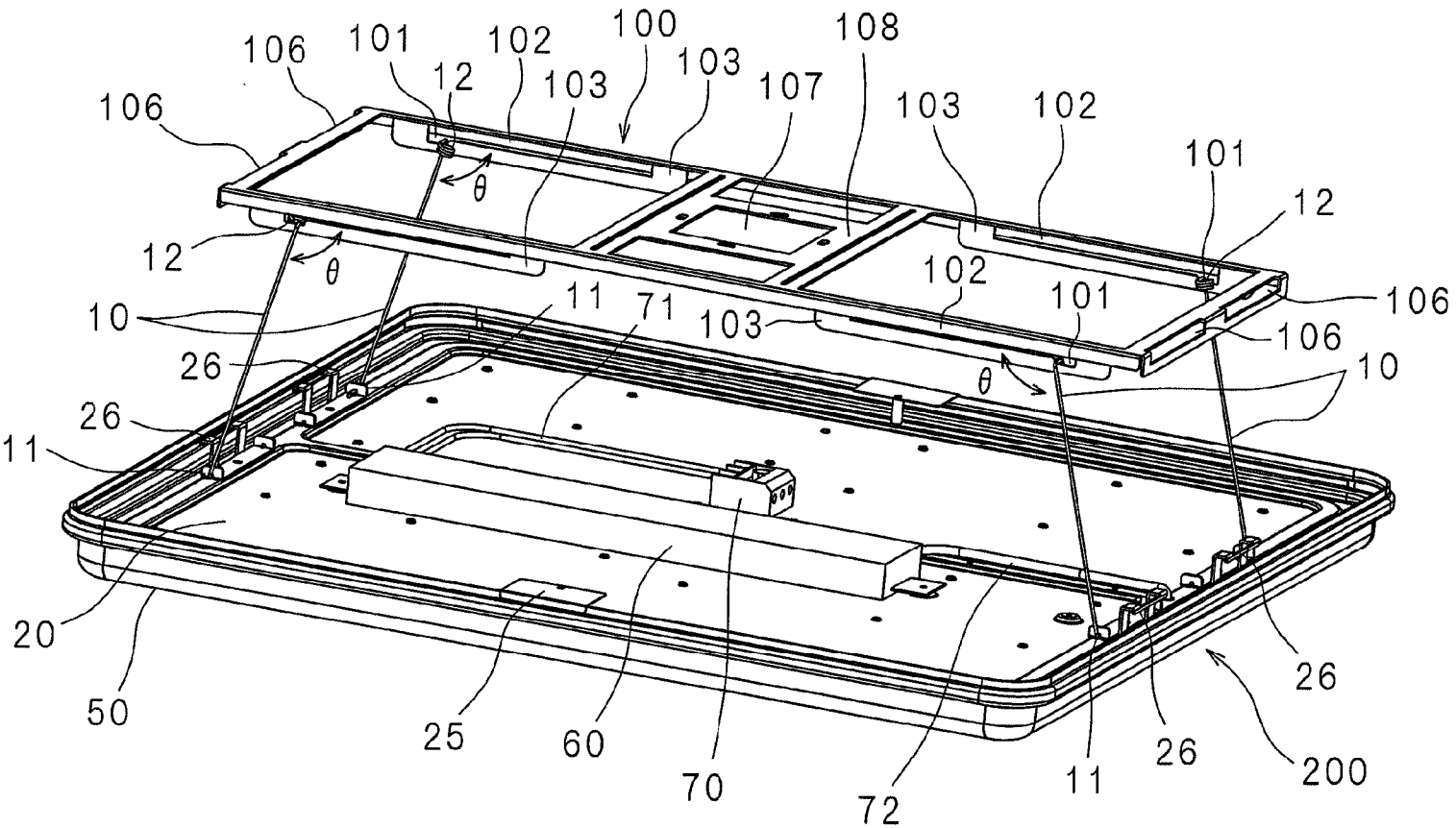
FIG. 5 is an external perspective view of the lighting apparatus in a state in which a lighting apparatus body is held with a holding metal fixture.

FIG. 5 is an external perspective view of the lighting apparatus according to the first embodiment of the invention in which lighting apparatus body 200 is held with the holding metal fixtures 10. Incidentally, the metal mounting 100 is fixed to a ceiling, a wall, or the like; however, the ceiling or the like is not depicted in FIG. 5 for the sake of simplification.

The metal mounting 100 is a rectangular metal frame; the cross section of the perimeter of the metal mounting 100 is shaped like a staple. At a substantially central part of the metal mounting 100, a mounting section 108 is provided; the mounting section 108 has an opening 107 through which a power source line is to be drawn. By screwing the mounting section 108 to a needed place of a ceiling or a wall, the metal mounting 100 can be fixed to the ceiling or the like. Note that the mounting 100 need not necessarily be made of a metal; the mounting 100 may be made of another material such as a synthetic resin provided that a required holding strength can be ensured.

At each long side of the metal mounting 100, erect sections 103 are provided straight in a direction in which the lighting apparatus body 200 is to be fitted to the metal mounting 100. At one end portion of each erect section 103 (a portion of each erect section 103 near each short side of the metal mounting 100), an insertion hole 101 that is of a required size is made; and besides, at each long side of the metal mounting 100, two guide slits 102 are provided such that each guide slit 102 extends straight from the insertion hole 101 along the erect section 103. Each guide slit 102 is a guide section for the holding metal fixture 10, and the width of the slit 102 is therefore smaller than the width of the insertion hole 101.

At each short side of the metal mounting 100, two rectangular openings 106 are made at an appropriate spacing. The shape of each opening 106 is not limited to the shape shown in FIG. 5; a hole, an aperture, or a notch may be made.

On the back surface of the chassis 20 (the side opposite to the board 30 fitting surface, i.e., the side opposite to the luminous surface), hooking sections 26 having a cross section shaped like a letter S are provided at locations corresponding to locations of the openings 106. By putting end portions of the hooking sections 26 into the openings 106, the lighting apparatus body 200 is fitted to the metal mounting 200. Incidentally, the size of the openings 106 is made larger than the size of the end portions of the hooking sections 26; since the end portions of the hooking sections 26 are merely put in the openings 106, the lighting apparatus body 200 can be detached easily.

With fitting of the lighting apparatus body 200, when the end portions of the hooking sections 26 have been put in the openings 106, the lighting apparatus body 200 is fitted to the metal mounting 100 by the weight of the lighting apparatus body 200 itself; with detachment of the lighting apparatus body 200, by lifting the lighting apparatus body 200 to some extent, the end portions of the hooking sections 26 can be detached from the openings 106. Incidentally, it is also possible to provide a lock mechanism in order to prevent unwanted play from resulting in a state of being mounted and to prevent the lighting apparatus body 200 from becoming detached by mistake.

Each holding metal fixture 10 is a metal rod; one end portion 11 of each holding metal fixture 10 is loosely fitted to the chassis 20. As shown in FIG. 5, the end portions 11 may be loosely fitted to the hooking section 26, for example. Locations where the end portions 11 are to be loosely placed can be determined as deemed appropriate. At the other end portion of each holding metal fixture 10, a lock section 12 is provided; the lock sections 12 can be inserted into insertion holes 101 of the holding metal fixtures 100. Each lock section 12 can be formed by, for example, coiling the end portion opposite to the end portion 11 at a predetermined diameter. The diameter of the lock sections 12 is smaller than the diameter of the insertion holes 101, and is larger than the width of the guide slits 102. Note that each holding metal fixture 10 need not necessarily be made of a metal; another material, such as a synthetic resin, may be used provided that it has a required strength.

The holding metal fixtures 10 can each move up and down on a virtual plane along the direction of the length of the chassis 20 around the end portion 11 loosely fitted to the chassis 20.

At the back surface of the chassis 20, components necessary for wiring are provided such as a terminal block 70 to which a power source line connected to an external power source, such as a commercial power source, is connected, a power supply unit 60, a hard-wire 71 provided between the terminal block 70 and the power supply unit 60, and a hard-wire 72 provided between the power supply unit 60 and the board 30.

At a substantially central, inner part of the perimetric portion at each long side of the chassis 20, a metal fixture 25 is provided to fix the cover 50.

In a case where wiring work on the lighting apparatus body 200 is carried out in a state in which such a structure is formed, by inserting the lock sections 12 of the holding metal fixtures 10 loosely fitted to the lighting apparatus body 200 into the insertion holes 101 of the metal mounting 100 and then locking the holding metal fixtures 10 on the metal mounting 100, the lighting apparatus body 200 is held in a manner that keep a spacing from the metal mounting 100. Since the holding metal fixtures 10 are shaped like a rod and somewhat flexible, the lock sections 12 can be easily inserted into the insertion holes 101. And further, since the holding metal fixtures 10 have such a rod-like shape, the mounting work is not obstructed. Moreover, even in a case where the lighting apparatus body 200 is heavy due to implementation of a large number of luminous elements such as the light emitting diodes 1 and 2, the lighting apparatus body 200 can be held easily because such a simple structure is formed; therefore mounting work on the lighting apparatus body 200 can be easily done alone, and heightened workability is achieved.

In a case where the mounting work including the wiring work has been finished with the lighting apparatus body 200 held as shown in FIG. 5, by pushing up the lighting apparatus body 200 toward the metal mounting 100 fixed to the ceiling, the lock section 12 sides of the holding metal fixtures 10 can be slid along the guide slits 102 as guides, and the lighting apparatus body 200 can be moved toward the metal mounting 100. Then the holding metal fixtures 10 can be housed between the metal mounting 100 and the lighting apparatus body 200 along the guide slits 102 with the lighting apparatus body 200 fitted to the metal mounting 100. Therefore, when the lighting apparatus body 200 has been mounted to the mounting surface, a state is brought about in which housing sections for housing the holding metal fixtures 10 between the lighting apparatus body 200 and the metal mounting 100 are provided, that is, the holding members are not seen from outside, and thus the lighting apparatus can have a neat appearance.

When the lighting apparatus body 200 is held as shown in FIG. 5, an angle θ formed between the holding metal fixtures 10 and the guide slits 102 (the long sides of the guide slits 102) as the guides is set at greater than 90°. Therefore, when the lighting apparatus body 200 has been pushed up toward the metal mounting 100 fixed to the ceiling, a force that makes the holding metal fixtures 10 slide along the guide slits 102 operates; that is, by merely pushing up the lighting apparatus body 200, the holding metal fixtures 10 can be easily slid along the guide silts 102, and the holding metal fixtures 10 can be housed between the metal mounting 100 and the lighting apparatus body 200.

Figure 6:
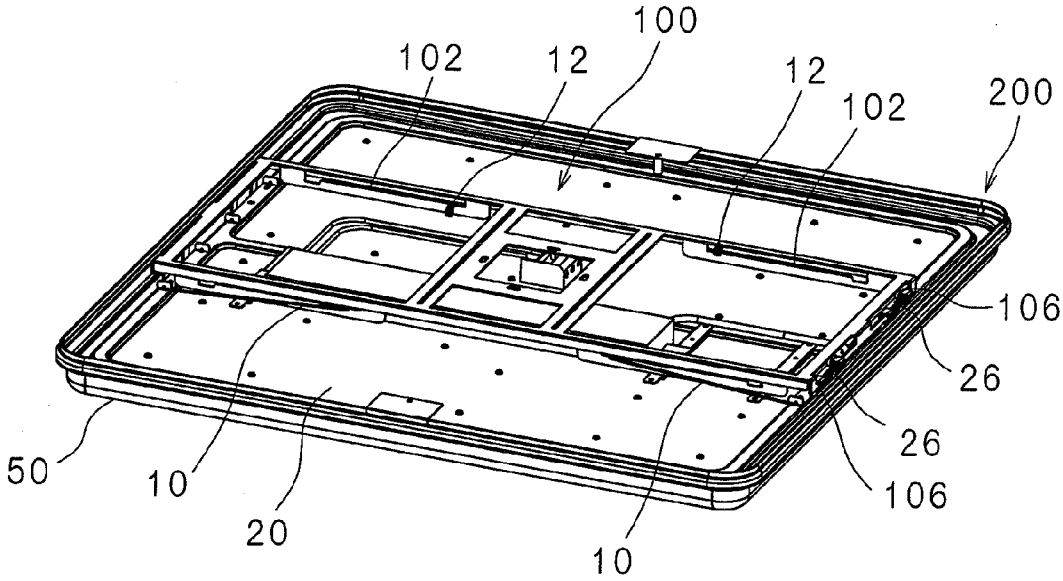
FIG. 6 is an external perspective view of the lighting apparatus in a state in which the lighting apparatus body is fitted to a metal mounting.

FIG. 6 is an external perspective view of the lighting apparatus according to the first embodiment in a state in which the lighting apparatus body 200 is fitted to the metal mounting 100. With respect to the state shown in FIG. 6, by putting the end portions of the hooking sections 26 into the openings 106, the lighting apparatus body 200 is fitted to the metal mounting 100 by the weight of the lighting apparatus body 200 itself. At that time, the lock sections 12 are in a state in which they are moved to the sides opposite to the insertion holes 101 of the guide slits 102. Even if the end portions of the hooking sections 26 become detached from the openings 106, it is possible to prevent the lighting apparatus body 200 from falling from the ceiling because the lighting apparatus body 200 is held by the holding metal fixtures 10.

Since the lighting apparatus body 200 can be held in a manner that keeps a spacing from the ceiling or the like as described above, wiring work can be done even when the components necessary for the wiring work are provided at the back surface side of the chassis 20. Thus, there is no need to provide the wiring components at the board 30 fitting surface, and light can, therefore, be emitted from a luminous surface about the same size as the size of the diffusing panel of the lighting apparatus, that is, a broad luminous surface can be secured. Note that the lighting apparatus according to this embodiment has the structure in which one end portion of each rod-shaped holding metal fixture 10 is fitted to the lighting apparatus body 200, the other end portion has the lock section 12 to be locked on the metal mounting 100, the lock sections 12 are licked on the metal mounting 100 after having been inserted into the insertion holes 101, and the holding metal fixtures 10 are slid along the guide slits 102 as the guides, but a structure may be used in which the relationship between both the end portions of each holding metal fixture 10 is inverted.

The lighting apparatus body 200 includes the chassis 20 to which the holding metal fixtures 10 are loosely fitted, the board 30 on which the luminous elements are provided, and the cover 50 with which the board 30 is covered; because of this, mounting work on the lighting apparatus body 200 is not required at the luminous surface side where the luminous elements are provided. Moreover, even when the lighting apparatus body 200 is heavy, mounting work can be easily done.

Although FIG. 5 shows the structure in which the power supply unit 60 is fitted on the back surface of the chassis 20, a place where the power supply unit 60 is fitted is not limited; for example, it may be placed in a ceiling space or the like. In a case where a large power supply unit is used in particular, a spacing between a ceiling and a luminous surface can be shortened by installing the power supply unit outside, whereby a low-profile lighting apparatus can be implemented. And further, if the power supply unit 60 can be downsized, a low-profile lighting apparatus can be implemented even when the power supply unit 60 is fixed on the back surface of the chassis 20.

Although the terminal block 70 is fitted on the back surface of the chassis 20 in this embodiment, wiring may be carried out on the ceiling by using a rosette instead of the terminal block 70. Even if either of them is used, light emission across the diffusing panel can be achieved because such a component is to be provided on the back surface of the chassis 20 (the upper surface side of the lighting apparatus body 200).

Although FIG. 5 shows the structure where the four holding metal fixtures 10 are provided, the number of the holding metal fixtures 10 is not limited to such an example; that is, a structure where only one holding metal fixture 10 is provided may be used, and a structure where one holding metal fixture 10 is provided at the perimetric portion at each long side or each short side of the lighting apparatus body 200, i.e., a structure where a total of two holding metal fixtures 10 are provided may be used.

Figure 7:
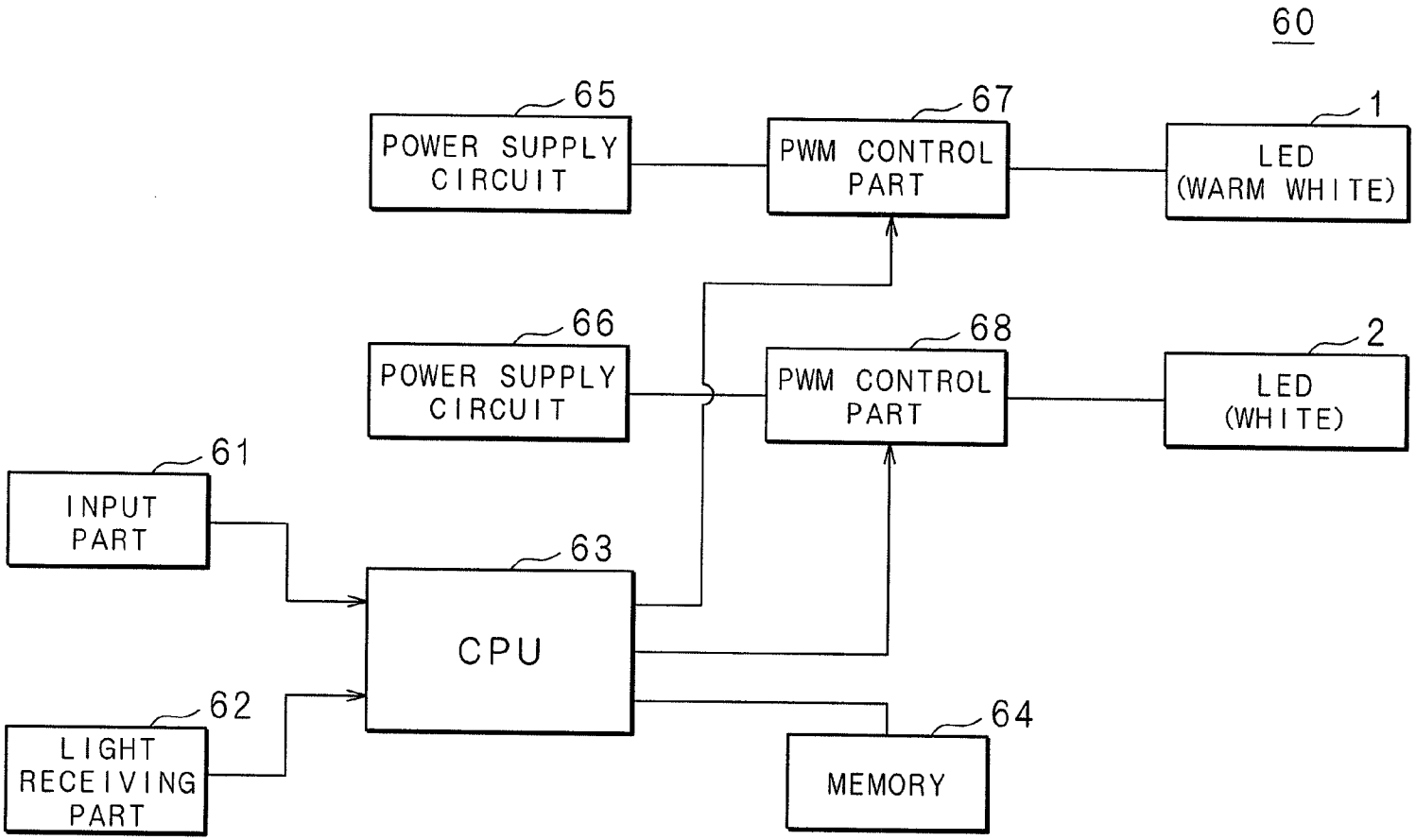
FIG. 7 is a block diagram of an example of a power supply unit.

FIG. 7 is a block diagram of an example of the power supply unit 60. The power supply unit 60 includes an input part 61 to detect an on-off state of a wall switch (not shown), a light receiving part 62 that receives a signal (e.g., infrared light or the like) from a remote controller (not shown), a CPU 63 that includes a timer etc. and that controls the whole power supply unit 60, a memory 64 to store specified information, power supply circuits 65 and 66 each provided with a constant-current circuit etc., a PWM control part 67 to apply a required voltage to the warm white light emitting diodes (LEDs) 1 by PWM control, and a PWM control part 68 to apply a required voltage to the high-color-rendering white light emitting diodes (LEDs) 2 by PWM control.

Color temperature control means can be constituted by the CPU 63 and the PWM control parts 67 and 68. Incidentally, as to the input part 61 and the light receiving part 62, either of a structure where both of them are provided and a structure where either of them is provided may be used. And further, the power supply circuits 65 and 66 may be integrated into one power supply circuit.

Figure 8:
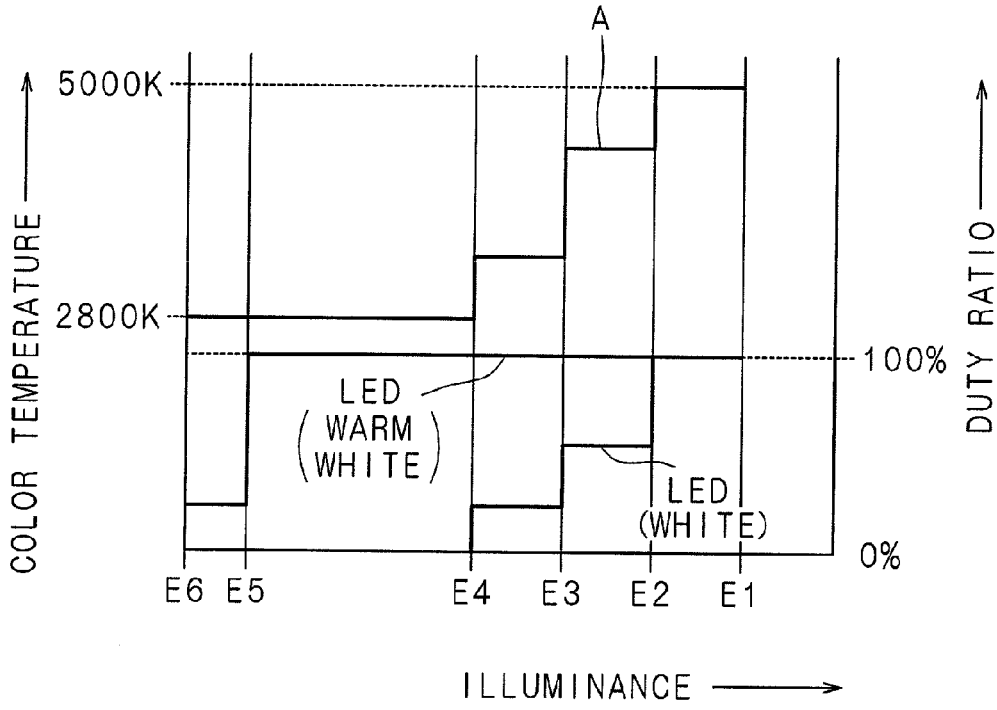
FIG. 8 is an explanatory drawing of an example of a relationship between illuminance of the lighting apparatus according to the first embodiment and color temperature of a light source.

Next, operation of the power supply unit 60 will now be described. FIG. 8 is an explanatory drawing of an example of a relationship between illuminance of the lighting apparatus according to this embodiment and color temperature of the light source, and FIG. 9 is a table showing several examples of control states set at the lighting apparatus according to this embodiment. In FIG. 8, the horizontal axis indicates the illuminance that means an example of brightness of illumination by the lighting apparatus, and the vertical axis indicates not only the color temperature of the light source (the light emitting diodes 1 and 2) measured at the luminous surface but duty ratios of voltages applied to the light emitting diodes 1 (the warm white LEDs) and the light emitting diodes 2 (the white LEDs). A line shown with a letter A in FIG. 8 indicates the relationship between the color temperature of the light source and the illuminance of the lighting apparatus.

In FIG. 8, a case where the illumination is bright, i.e., a high illuminance side (a case where the illuminance is higher than a value E4) means a state in which both of the light emitting diodes 1 (the warm white LEDs) and the light emitting diodes 2 (the white LEDs) are lit. On the other hand, a case where the illumination is dim, i.e., a low illuminance side (a case where the illuminance is lower than the value E4) means a state in which only the light emitting diodes 1 (the warm white LEDs) are lit and the light emitting diodes 2 (the white LEDs) are put out.

As shown in FIGS. 8 and 9, the brightness (illuminance) of the illumination is controlled in stages. For example, as shown in FIG. 9, when the control state is an S1 state (all lighting), the illuminance is E1, i.e., highest; in such a state, the duty ratios of voltages applied to the light emitting diodes 1 (the warm white LEDs) and the light emitting diodes 2 (the white LEDs) are 100%.

In a case where the control state is an S2 state, the illuminance is E2 (<E1), the duty ratio of a voltage applied to the light emitting diodes 1 (the warm white LEDs) is 100%, and the duty ratio of a voltage applied to the light emitting diodes 2 (the white LEDs) is 60%.

In a case where the control state is an S3 state, the illuminance is E3 (<E2), the duty ratio of a voltage applied to the light emitting diodes 1 (the warm white LEDs) is 100%, and the duty ratio of a voltage applied to the light emitting diodes 2 (the white LEDs) is 30%.

In a case where the control state is an S4 state, the illuminance is E4 (<E3), the duty ratio of a voltage applied to the light emitting diodes 1 (the warm white LEDs) is 100%, and the duty ratio of a voltage applied to the light emitting diodes 2 (the white LEDs) is 0%, that is, the light emitting diodes 2 are in a lights-out state.

In a case where the control state is an S5 state, the illuminance is E5 (<E4), the duty ratio of a voltage applied to the light emitting diodes 1 (the warm white LEDs) is 30%, and the light emitting diodes 2 (the white LEDs) are in a lights-out state. And further, a control state S6 means lights out.

As can be seen from the above description, when the illumination is dark (at the time when illuminance is low, for example), the CPU 63 and the PWM control parts 67 and 68 as the color temperature control means change a color temperature of the light source constituted by the light emitting diodes 1 and 2 to a low color temperature; when the illumination is bright (at the time when illuminance is high, for example), they change a color temperature of the light source to a high color temperature. For example, when the room has been darkened by lowering illuminance, the color temperature control means changes the color of the illumination to a warm white color; when wanting to lighten the room, the color temperature control means changes the color of the illumination to a high-color-rendering white color; that is, it is possible to obtain illumination presenting a suitable color temperature in accordance with various time zones and lifestyles.

When the illumination is bright, the lighting apparatus is configured to change the color temperature in accordance with the brightness; when the illumination is dark, the lighting apparatus is configured to generate a specified color temperature. For example, on the high illuminance side where it is desirable to make the room bright to some extent, the color temperature is heightened as the illuminance heightens, and the color temperature is lowered as the illuminance lowers. On the other hand, on the low illuminance side where it is desirable to darken the room, a change to a specified color temperature is made (for example, a change to a color temperature of 2800 K (that means a warm white color) is made). Therefore it is possible to obtain illumination presenting a suitable color temperature in accordance with various time zones and lifestyles. Note that although the color temperature of 2800 K is used as a specified color temperature in FIG. 8, the color temperature is not limited to such a value.

When the illumination is bright (is on a high illuminance side, for example), the lighting apparatus is configured to apply a voltage with a predetermined duty ratio (of 100%, for example) to the warm white light emitting diodes 1, and a voltage with a duty ratio (of 0% to 100%) corresponding to specified brightness is applied to the high-color-rendering white light emitting diodes 2. That is, when the illumination is bright, the color temperature of the lighting apparatus can be changed in accordance with illuminance, whereby it is possible to obtain illumination presenting a suitable color temperature in accordance with various time zones and lifestyles.

When the illumination is dark (is on a low illuminance side, for example), a voltage with a duty ratio (of 0% to 100%) corresponding to specified brightness is applied to the warm white light emitting diodes 1, and the high-color-rendering white light emitting diodes 2 are put out. That is, when the illumination is dark, it is possible to lower the illuminance while keeping the color temperature of the lighting apparatus constant, whereby it is possible to obtain illumination presenting a suitable color temperature in accordance with various time zones and lifestyles.

On the remote controller (not shown), operating buttons for "all lighting", "sequential operation", "lights out", "high illuminance adjustment", "low illuminance adjustment", etc. are provided in advance; for example, every time "sequential operation" is performed, the control state changes between the S1 state and the S5 state in turn. When the operation of "high illuminance adjustment" has been performed, the duty ratios of voltages applied to the light emitting diodes 1 and 2 are increased by predetermined values; when the operation of "low illuminance adjustment" has been performed, the duty ratios of voltages applied to the light emitting diodes 1 and 2 are decreased by predetermined values, whereby it is possible to finely adjust the brightness of the illumination.

By performing on-off operation of the wall switch (not shown), it is also possible to change the control state. For example, when the wall switch has been turned on within two seconds of turn off of the wall switch, the control state changes between the S1 state and the S5 state in turn. Elapsed time can be measured with the timer included in the CPU 63. Incidentally, the elapsed time of two second is only one example; therefore the elapsed time is not limited to such a value.

When the wall switch has been turned on two seconds after turn off of the wall switch, the lighting apparatus is lit into an all lighting (S1) state. In addition, it is also possible to light the lighting apparatus in a state of having been lit just before the lighting.

Figure 10:
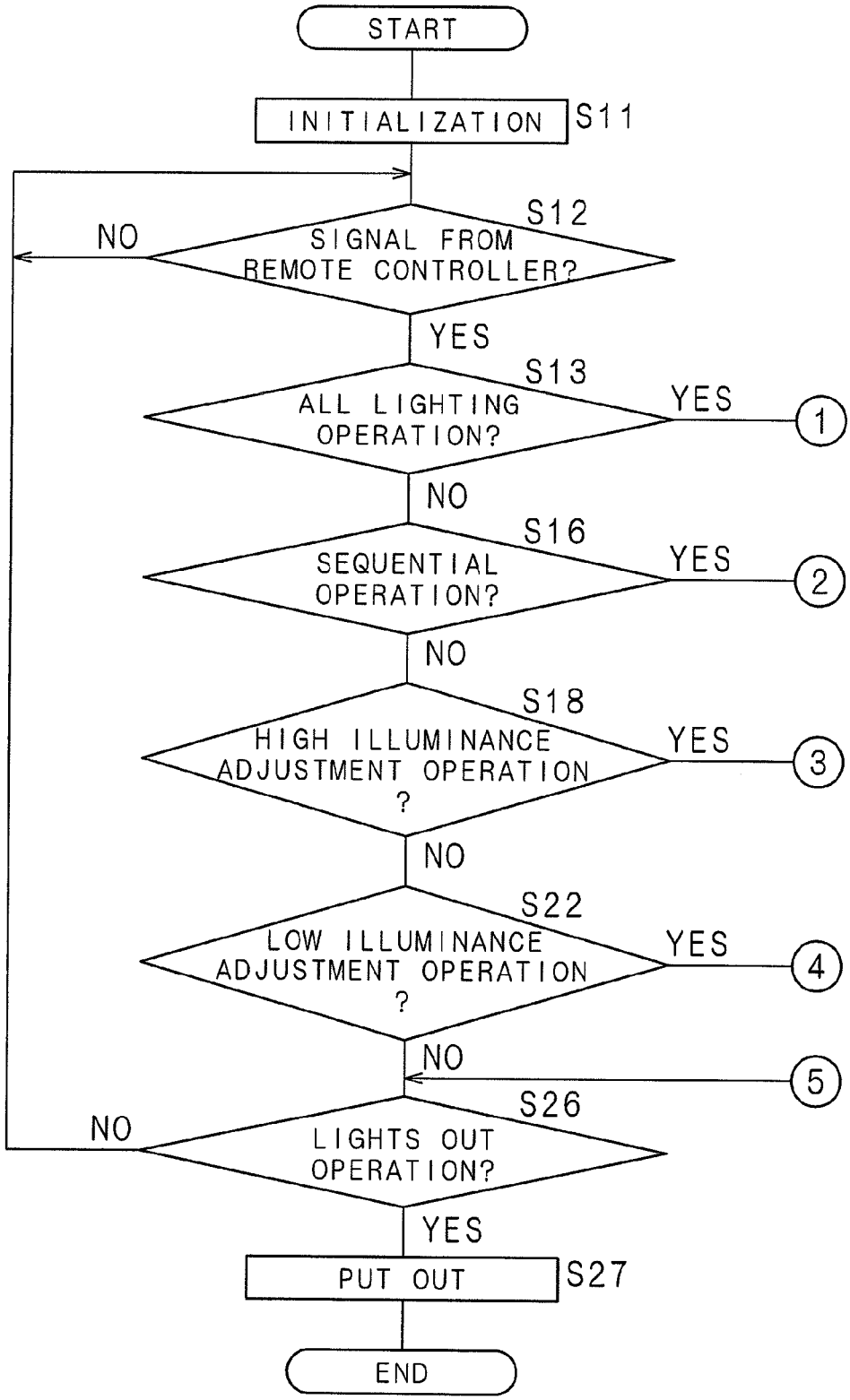
FIG. 10 is a flowchart of processing procedure employed in a case where a remote controller for the lighting apparatus according to the first embodiment is used.
Figure 11:
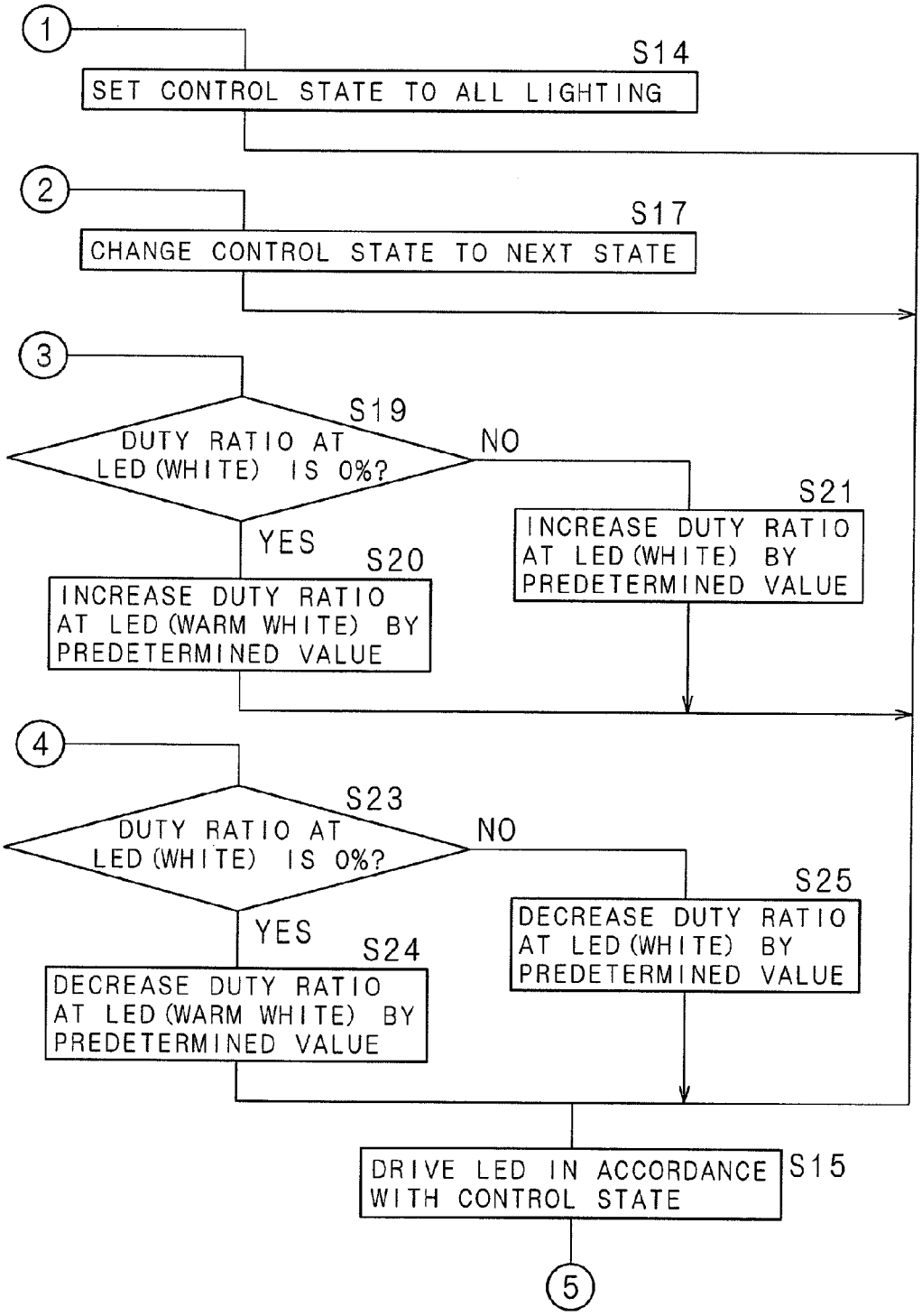
FIG. 11 is a flowchart of processing procedure employed in the case where the remote controller for the lighting apparatus according to the first embodiment is used.

FIGS. 10 and 11 are each a flowchart of a processing procedure employed in a case where the remote controller of the lighting apparatus according to this embodiment is used. The CPU 63 executes initialization such as initial setting of data on the control state and so on (S11), and determines whether or not any signal has been sent from the remote controller (S12). When no signal has been sent from the remote controller (NO in S12), the CPU 63 continues the processing at step S12.

When having received a signal (YES in S12), the CPU 63 determines whether the received signal is a signal of all lighting operation or not (S13). When the received signal is a signal of all lighting operation (YES in S13), the CPU 63 sets the control state to all lighting (S14), and drives the LEDs in accordance with the control state (S15).

When the received signal is not a signal of all lighting operation (NO in S13), the CPU 63 determines whether the received signal is a signal of sequential operation or not (S16). When the received signal is a signal of sequential operation (YES in S16), a change to the next control state is made (S17), and the processing at step S15 is carried out.

When the received signal is not a signal of sequential operation (NO in S16), the CPU 63 determines whether the received signal is a signal of high illuminance adjustment operation or not (S18). When the received signal is a signal of high illuminance adjustment operation (YES in S18), the CPU 63 determines whether the duty ratio at the LEDs (to emit white light) is 0% or not (S19). When the duty ratio at the LEDs (to emit white light) is 0% (YES in S19), the CPU 63 increases the duty ratio at the LEDs (to emit warm white light) by a predetermined value (S20) and performs the processing at step S15. When the duty ratio at the LEDs (to emit white light) is not 0% (NO in S19), the CPU 63 increases the duty ratio at the LEDs (to emit white light) by a predetermined value (S21) and performs the processing at step S15.

When the received signal is not a signal of high illuminance adjustment operation (NO in S18), the CPU 63 determines whether the received signal is a signal of low illuminance adjustment operation or not (S22). When the received signal is a signal of low illuminance adjustment operation (YES in S22), the CPU 63 determines whether the duty ratio at the LEDs (to emit white light) is 0% or not (S23). When the duty ratio at the LEDs (to emit white light) is 0% (YES in S23), the CPU 63 decreases the duty ratio at the LEDs (to emit warm white light) by a predetermined value (S24) and performs the processing at step S15. When the duty ratio at the LEDs (to emit white light) is not 0% (NO in S23), the CPU 63 decreases the duty ratio at the LEDs (to emit white light) by a predetermined value (S25) and performs the processing at step S15.

When the received signal is not a signal of low illuminance adjustment operation (NO in S22), the CPU 63 determines whether the received signal is a signal of lights out operation or not (S26). When the received signal is not a signal of lights out operation (NO in S26), the CPU 63 continues the processing at step S12 and the subsequent steps. When the received signal is a signal of lights out operation (YES in S26), the CPU 63 puts out the LEDs (S27), whereby the processing is finished. Incidentally, after the LEDs have been put out at step S27, a return to step S12 may be made instead of finishing the processing, that is, the processing at step S12 may be continued until some signal is sent from the remote controller.

Figure 12:
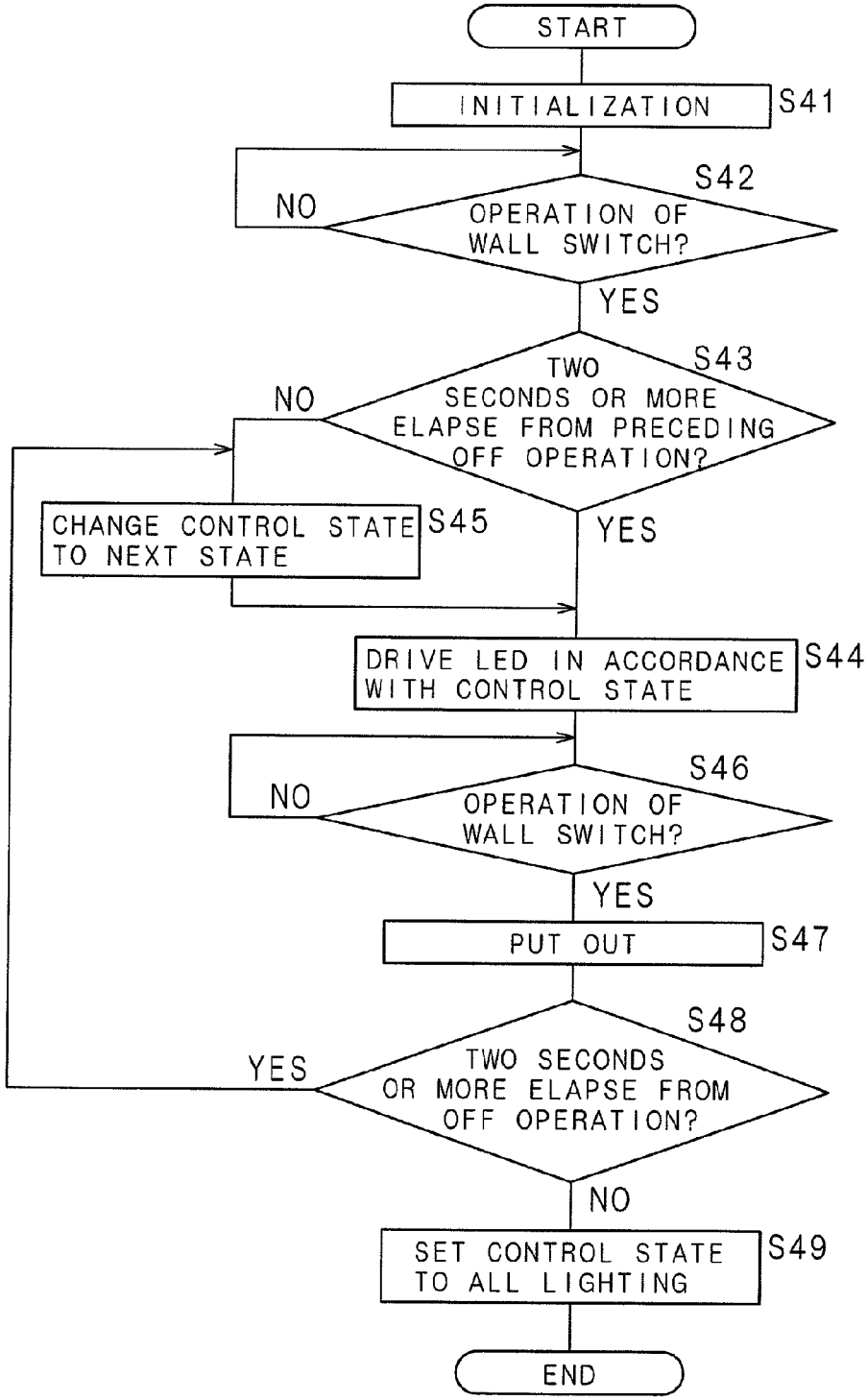
FIG. 12 is a flowchart of processing procedure employed in a case where a wall switch for the lighting apparatus according to the first embodiment is used.

FIG. 12 is a flowchart of processing procedure employed in the case of the wall switch for the lighting apparatus according to this embodiment is used. The CPU 63 executes initialization such as initial setting of data on the control state and so on (S41) and determines whether ON operation of the wall switch has been carried out or not (S42). When the ON operation of the wall switch has not been carried out (NO in S42), the CPU 63 continues the processing at step S42.

When the ON operation of the wall switch has been carried out (YES in S42), the CPU 63 determines whether or not two seconds or more have elapsed from immediately preceding OFF operation (S43). When two seconds or more have elapsed (YES in S43), the CPU 63 drives the LEDs in accordance with the control state (S44).

When two seconds or more have not elapsed from the immediately preceding OFF operation (NO in S43), the CPU 63 makes a change to the next control state (S45) and performs the processing at step S44. The CPU 63 determines whether OFF operation of the wall switch has been carried out or not (S46). When the OFF operation of the wall switch has not been carried out (NO in S46), the CPU 63 continues the processing at step S46.

When the OFF operation of the wall switch has been carried out (YES in S46), the CPU 63 puts out the LEDs (S47) and determines whether or not ON operation of the wall switch has been carried out within two seconds after the OFF operation (S48). When the ON operation of the wall switch has been carried out within two seconds after the OFF operation (YES in S48), the CPU 63 continues the processing at step S45 and the subsequent steps. When the ON operation of the wall switch has not been carried out within two seconds after the OFF operation (NO in S48), the CPU 63 sets the control state to all lighting (S49), whereby the processing is finished. Incidentally, after the control state has been set to the all lighting at step S49, a return to step S42 may be made instead of finishing the processing, that is, the processing at step S42 may be continued until ON operation of the wall switch is carried out.

Figure 13:
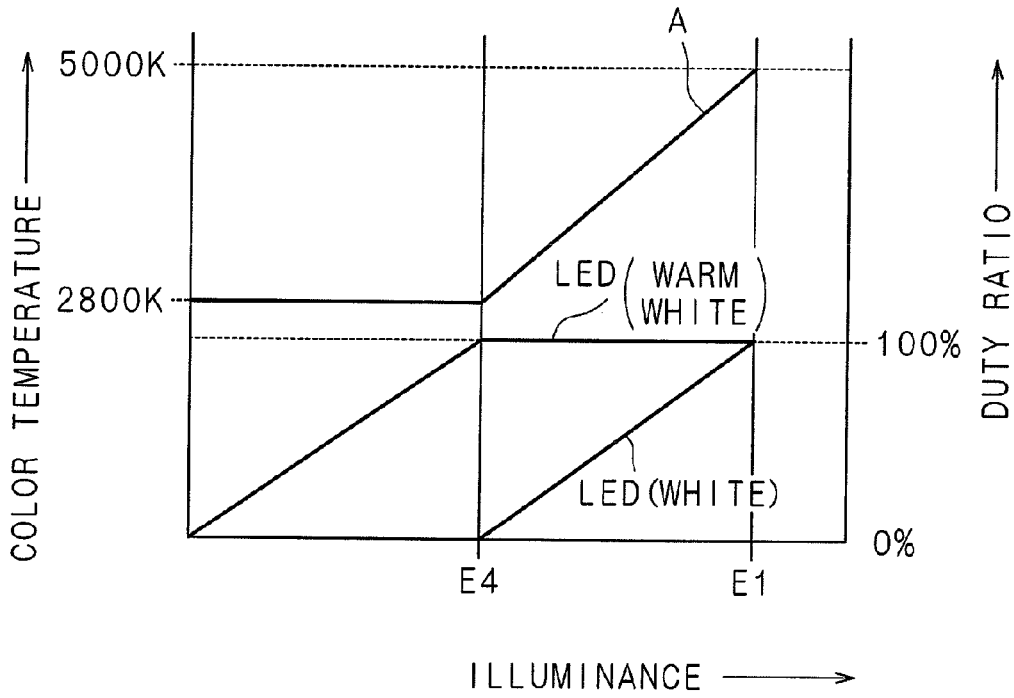
FIG. 13 is an explanatory drawing of another example of the relationship between the illuminance of the lighting apparatus according to the first embodiment and the color temperature of the light source.

Although the duty ratios of voltages to be applied to the LEDs are changed in stages in accordance with the brightness of the illumination as shown in FIG. 8, the method for controlling the color temperature of the light source is not limited to such a technique. FIG. 13 is an explanatory drawing of another example of the relationship between the illuminance of the lighting apparatus according to this embodiment and the color temperature of the light source. In FIG. 13, the horizontal axis indicates illuminance that is an example of brightness of illumination by the lighting apparatus, and the vertical axis indicates not only color temperature of the light source (consisting of the light emitting diodes 1 and 2) obtained at the luminous surface but duty ratios of voltages applied to the light emitting diodes 1 (the warm white LEDs) and the light emitting diodes 2 (the white LEDs). In FIG. 13, a line shown with a letter A indicates a relationship between the color temperature of the light source and the illuminance of the lighting apparatus. FIG. 13 is different from FIG. 8 in that the duty ratios of voltages applied to the LEDs in accordance with the brightness of the illumination are not changed in stages but are changed linearly.

Second Embodiment

Although the front and back surfaces of the lighting apparatus according to the first embodiment are rectangular, shapes of the front and back surfaces of a lighting apparatus according to a second embodiment of the present invention are not limited to such a shape; that is, both the surfaces may be circular. In that case, the chassis 20 is shaped into a circle, and the length of each long side of the metal mounting 100 is made equal to the diameter of the circular chassis 20. The structure of the metal mounting 100 and the shape of the holding metal fixture 10 are the same as those described in the first embodiment.

Figure 14:
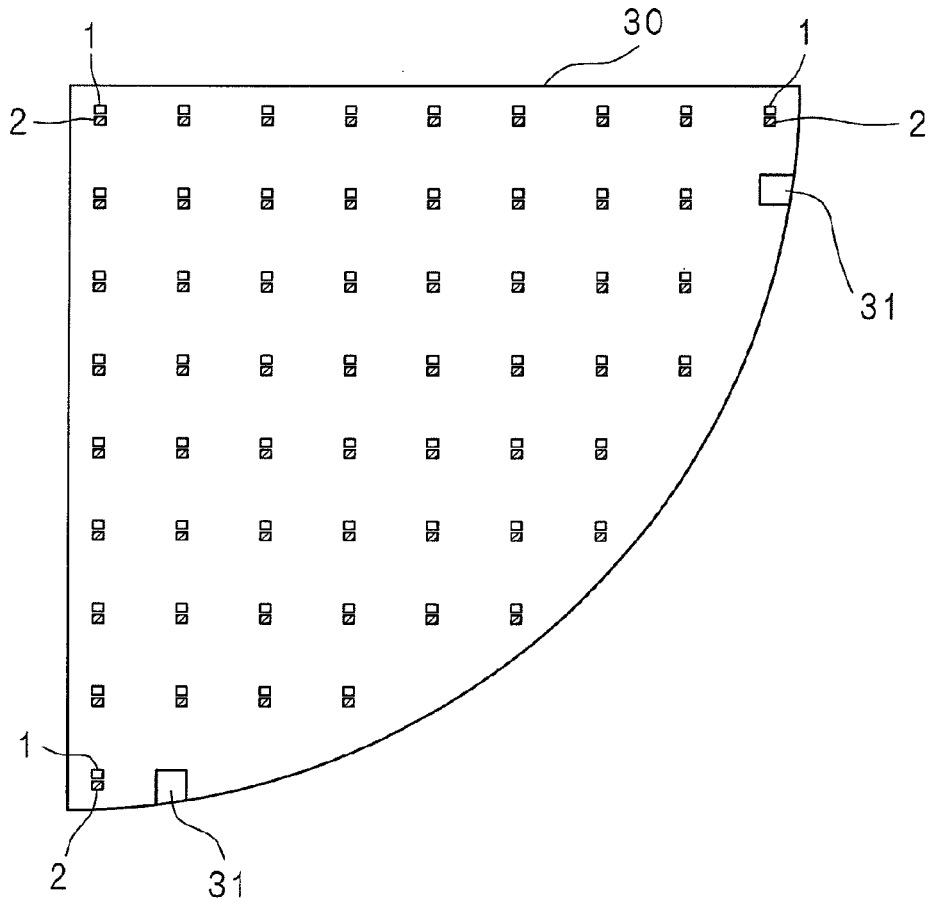
FIG. 14 is a plan view of a board according to a second embodiment.

FIG. 14 is a plan view of the board 30 according to the second embodiment. As shown in FIG. 14, the board 30 has a shape of a quarter of a circle; by adjacently placing the four boards 30, a circular luminous surface can be formed. And further, as in the case of the first embodiment, the plurality of diode sets, which each consist of the light emitting diode 1 and the light emitting diode 2 as luminous elements different in color temperature, are arranged in lattice form. With each diode set, the light emitting diodes 1 and 2 are adjacently provided with the separation distance d set (at 0.5 mm or 1 mm, for example) between them. Between the adjacent diode sets provided in the row direction, the separation distance x is set; between the adjacent diode sets provided in the column direction, the separation distance y is set. In that case, the separation distance d between the light emitting diode 1 and the light emitting diode 2 that constitute one diode set is made shorter than the separation distances x and y (of about 10 mm or 20 mm, for example) between the adjacent diode sets. Put another way, the separation distances x and y between the adjacent diode sets are made longer than the separation distance d between the light emitting diode 1 and the light emitting diode 2 that constitute one diode set. In this case, the separation distances x and y may be the same, or may be different. Moreover, although the diode sets are arranged such that the row and column directions are perpendicular to the perimeter of the board 30 in FIG. 14, the diode sets according to the second embodiment may be provided in lattice form such that their row direction is not perpendicular to one straight side of the board 30 and their column direction is not perpendicular to the other straight side of the board 30. As a result, even in a case where the luminous surface is shaped into any shape, even light emission can be achieved. And furthermore, by evenly spacing the diode sets in a manner that makes the separation distances x and y the same, a luminous surface that emits light more evenly can be implemented. In addition, the diode sets may be radially arranged, and this makes it possible to achieve even light emission even when the luminous surface is circular.

Third Embodiment

Figure 15:
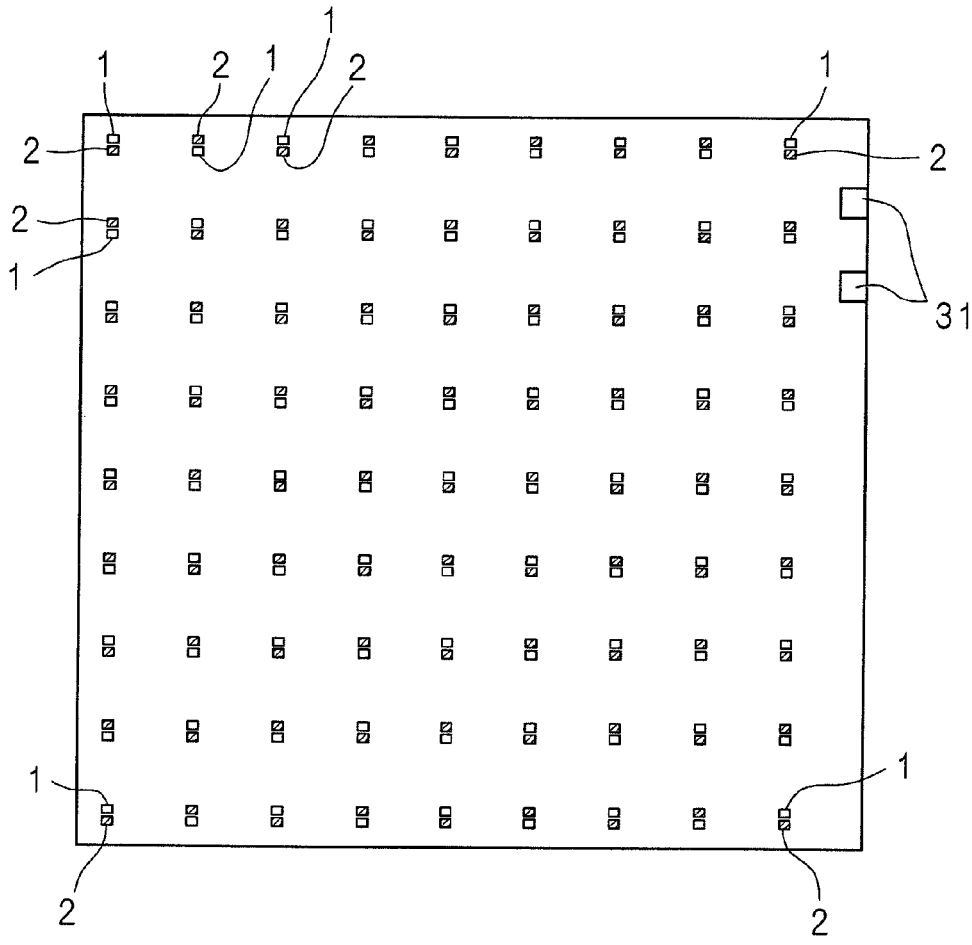
FIG. 15 is a plan view of a board according to a third embodiment.

FIG. 15 is a plan view of the board 30 according to a third embodiment. The third embodiment is different from the first embodiment in that the light emitting diodes 1 and 2 as luminous elements different in color temperature consisting the diode sets are staggerly arranged. That is, by viewing FIG. 15 in a state in which the connectors 31 are provided at the right-hand side of the board 30, it can be seen that the upper-left diode set is provided on the board 30 with the light emitting diode 1 sitting above the light emitting diode 2. With the diode set provided at the right of the upper-left diode set, the light emitting diode 2 sits above the light emitting diode 1. Likewise, the light emitting diodes 1 and 2 that constitute the diode sets adjacent to each other in the row and column directions are arrange staggerly.

By adjacently providing the light emitting diodes 1 and 2 that constitute one diode set, it is possible to prevent an occurrence of a problem that when having obliquely seen a luminous surface, you see the color of emitted light subtly differently depending on the direction of your line of sight because the light is not emitted evenly due to uneven spacings between light emitting diode packages. That is, even when having seen the luminous surface from any direction, a single luminous color can be obtained, i.e., unevenness of a luminous color does not result.

As this invention ma be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

The invention claimed is:

1. A lighting apparatus, comprising:

a mounting member to be fixed to a mounting surface;

a lighting apparatus body in which a light source is provided and which is to be mounted to the mounting surface through the mounting member; and a holding member holding the lighting apparatus body such that a space is provided between the mounting surface and the lighting apparatus body, wherein the holding member is shaped into a rod, and a first end portion of the holding member is fitted to the lighting apparatus body, and the mounting member has an insertion hole into which a second end portion of the holding member is inserted, and the mounting member has a guide extending from the insertion hole, and the holding member slides along the guide.

2. The lighting apparatus according to claim 1, further comprising a housing section housing the holding member between the lighting apparatus body and the mounting member when the lighting apparatus body is mounted to the mounting surface.

3. The lighting apparatus according to claim 2, wherein the second end portion of the holding member has a lock section to be locked on the mounting member, wherein the lock section is inserted into the insertion hole so as to lock the holding member.

4. The lighting apparatus according to claim 3, wherein the lighting apparatus body includes:

a chassis to which the holding member is fitted;

a luminous surface that has a luminous element and that is fitted to the chassis; and a cover that covers the luminous surface.

5. The lighting apparatus according to claim 3, wherein an angle formed between the holding member and the guide is greater than 90° in a state of holding the lighting apparatus body.

6. The lighting apparatus according to claim 5, wherein the lighting apparatus body includes:

a chassis to which the holding member is fitted;

a luminous surface that has a luminous element and that is fitted to the chassis; and a cover that covers the luminous surface.

7. The lighting apparatus according to claim 3, wherein the lighting apparatus body includes:

a chassis to which the holding member is fitted;

a luminous surface that has a luminous element and that is fitted to the chassis; and a cover that covers the luminous surface.

8. The lighting apparatus according to claim 2, wherein the lighting apparatus body includes:

a chassis to which the holding member is fitted;

a luminous surface that has a luminous element and that is fitted to the chassis; and a cover that covers the luminous surface.

9. The lighting apparatus according to claim 1, wherein the second end portion of the holding member has a lock section to be locked on the mounting member, wherein the lock section is inserted into the insertion hole so as to lock the holding member.

10. The lighting apparatus according to claim 9, wherein the lighting apparatus body includes:

a chassis to which the holding member is fitted;

a luminous surface that has a luminous element and that is fitted to the chassis; and a cover that covers the luminous surface.

11. The lighting apparatus according to claim 9, wherein an angle formed between the holding member and the guide is greater than 90° in a state of holding the lighting apparatus body.

12. The lighting apparatus according to claim 11, wherein the lighting apparatus body includes:

a chassis to which the holding member is fitted;

a luminous surface that has a luminous element and that is fitted to the chassis; and a cover that covers the luminous surface.

13. The lighting apparatus according to claim 9, wherein the lighting apparatus body includes:

a chassis to which the holding member is fitted;

a luminous surface that has a luminous element and that is fitted to the chassis; and a cover that covers the luminous surface.

14. The lighting apparatus according to claim 1, wherein the lighting apparatus body includes:

a chassis to which the holding member is fitted;

a luminous surface that has a luminous element and that is fitted to the chassis; and a cover that covers the luminous surface.

* * * * *